313-414 SR
1/1/80 OR 4,181,870

United States Patent [19]
Stevens

[11] 4,181,870
[45] Jan. 1, 1980

[54] ASSEMBLY OF ELECTRON GUNS HAVING DIFFERENT GAMMA VALUES

[75] Inventor: Michael T. Stevens, Wilmette, Ill.

[73] Assignee: Zenith Radio Corporation, Glenview, Ill.

[21] Appl. No.: 884,670

[22] Filed: Mar. 8, 1978

[51] Int. Cl.[2] ..... H01J 29/08; H01J 29/32; H01J 29/50

[52] U.S. Cl. ..... 313/414; 313/415; 313/470

[58] Field of Search ..... 313/414, 415, 411, 467, 313/470, 409

[56] References Cited

U.S. PATENT DOCUMENTS

| | | | |
|---|---|---|---|
| 3,393,336 | 7/1968 | de France et al. | 313/409 |
| 3,755,703 | 8/1973 | Veno et al. | 313/409 |
| 3,889,145 | 6/1975 | Suzuki et al. | 313/470 X |
| 4,029,988 | 6/1977 | Say | 313/414 |
| 4,119,884 | 10/1978 | Blumenberg et al. | 313/414 X |

*Primary Examiner*—Palmer C. Demeo
*Attorney, Agent, or Firm*—John H. Coult

[57] ABSTRACT

This disclosure depicts a novel apparatus for use in a color television picture tube having a faceplate attached to the mouth of a funnel portion. The faceplate has an electron excitable phosphor screen deposited on the inner surface thereof, the phosphor screen having groups of at least two different types of phosphor elements. The funnel portion has a neck attached thereto opposite the mouth, the neck containing an electron gun assembly having at least two electron guns for directing at least two streams of electrons towards the phosphor screen. The two types of phosphor elements differ in the intensity of their light output for a predetermined current in the impinging electron stream, that is, they have different functional dependencies on the current of the electron stream. The electron gun assembly is characterized by having first means in a first electron gun for causing the first electron gun, when in operation, to have a first value of gamma, and second means in a second electron gun for causing the second electron gun to have a second value of gamma. The first value of gamma is different from the second value of gamma. The first and second values of gamma for the electron gun assembly are such that the light output intensity ratio of the two types of phosphor elements is substantially constant for a given ratio of drive voltages on the first and second electron guns.

8 Claims, 4 Drawing Figures

ASSEMBLY OF ELECTRON GUNS HAVING DIFFERENT GAMMA VALUES

BACKGROUND OF THE INVENTION

The present invention relates generally to color television picture tubes used in color reproduction and more particularly, to an apparatus for preventing a grey scale imbalance during operation of the color television picture tube.

Color television picture tubes of the type with which the present invention is concerned have an evacuated envelope made of glass with an enlarged end carrying a faceplate, and at its opposite end a neck portion containing an electron gun for projecting a stream of electrons toward an image screen on the inside surface of the faceplate. The energy of the electrons is converted into light by the image screen which is comprised of a suitable phosphor layer. The color television picture tube is preferably provided with an image screen which is differentiated from point to point in that adjacent elements of different phosphor material produce light of different colors. A perforate shadow mask is disposed between the electron gun and the image screen and is adjacent to the screen. The mask is provided with a large number of small, closely spaced apertures geometrically related in position and size to the different phosphor elements on the screen. The relation of the apertures to the phosphor elements and the electron beam sources is such that, by appropriate placement of the electron beam apparent sources, different phosphor elements, producing predetermined color emission, can be selectively energized to produce a visible picture corresponding to the original scene.

Depending on the type of phosphor material used to form the image screen, the light output of a phosphor element when it is impinged by a stream of electrons may be linearly or nonlinearly related to the current in the stream of electrons. In the case of a nonlinear phosphor material, the brightness or light output intensity of the phosphor element is proportional to the current in the stream of electrons raised to a power which is different from unity. For a linear phosphor material the light output intensity is directly proportional to the current.

Typical color television transmission systems, for the purpose of improving signal-to-noise ratio and for other reasons, to be explained, transmit an electrical signal that is not linearly proportional to the desired light output or brightness at the color television receiver.

A typical electron gun used in a color television picture tube has a nonlinear beam current-versus-control-signal characteristic that approximates a power law with an exponent (termed the "gamma") somewhere between 2 and 3. To compensate for the nonlinearity of the CRT, the transmitted signal has an amplitude compression that corresponds to a fractional power law. The exponent in the fractional power law is approximately 0.45. Depending on the type of phosphor material used for the phosphor elements in the electron excitable phosphor screen of the picture tube, the gamma value of the gun may have to be adjusted slightly to produce a given light output from the phosphor element.

In a color television picture tube where the phosphor elements are all composed of the same type of phosphor material, no problem is posed for a unitized-type electron gun assembly. Unitized electron gun assemblies can be designed for a predetermined value of gamma. However, modern color television picture tubes are usually formed with different types of phosphor materials used for the different colors of phosphor elements. For example, the red phosphor element may be a linear type phosphor material, whereas the blue and green phosphor elements may be a nonlinear type phosphor material. As a result, for high drive voltages on a unitized electron gun assembly the red phosphor element will emit more light disproportionate to the blue and green phosphor elements due to the sub-linearity of the blue and green elements. Electronic circuits have been added to color television receivers to produce a constant light output intensity ratio for the three different phosphor elements on the screen for a given drive voltage ratio on the electron gun assembly at the input of the corrective circuitry. This approach however is not desirable in that it adds an additional electronic circuit to the receiver, thereby increasing the cost of the receiver. Also, this approach is not always entirely successful in preventing a grey scale imbalance. Typically, this appears as a centered pink donut on the screen of the tube for a screen composed of red linear phosphor elements and blue and green sublinear phosphor elements.

This invention has general applicability and is advantageously applied to a shadow mask type color television picture tube having a unitized electron gun assembly wherein the phosphor elements which comprise the screen of the tube utilize dissimilar types of phosphor materials.

OBJECTS OF THE INVENTION

It is a general object of the present invention to provide for a color television picture tube an improved electron gun assembly which prevents a grey scale imbalance from appearing on the screen of the color television picture tube when in operation.

It is another object of the present invention to provide an electron gun assembly which causes the light output intensity ratio of the phosphor elements of the screen of the tube to be constant for a given ratio of drive voltages on the electron gun assembly.

It is yet another object of the present invention to provide a color television picture tube which eliminates a number of electronic components in a color television receiver, thereby reducing the cost of the receiver.

It is a further object to provide an electron gun assembly which improves the performance of the containing color television picture tube.

BRIEF DESCRIPTION OF THE DRAWINGS

The features of the present invention which are believed to be novel are set forth with particularity in the appended claims. The invention together with further objects and advantages thereof, may best be understood by reference to the following description taken in conjunction with accompanying drawings, in the several figures of which like reference numerals identify like elements and in which:

DESCRIPTION OF THE PREFERRED EMBODIMENT

Figure 1:
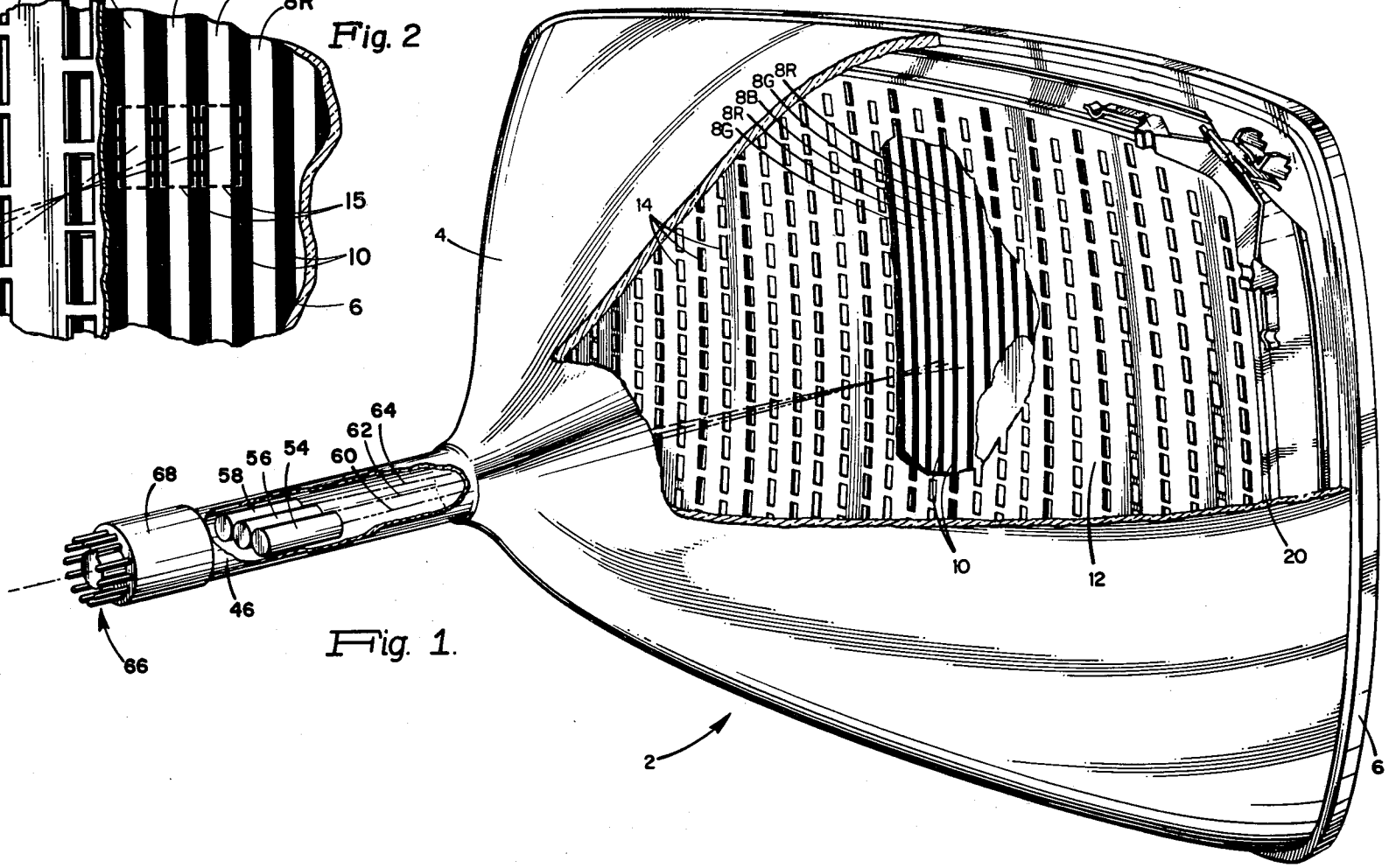
FIG. 1 is a perspective view of a color television picture tube partly broken away to reveal an electron gun assembly and a tri-color, line-type image screen having a plurality of triads of red-light-emissive, blue-light-emissive and green-light-emissive phosphor elements, the elements being spaced each from one another by light-absorbing materials.

This invention pertains to an electron gun assembly for use in a color television picture tube and, specifically, for preventing a grey scale imbalance in the screen of the tube during operation. Whereas the invention may be implemented in color television picture tubes of various types, it is preferably embodied in a shadow mask type tube of the nature shown in FIG. 1. The tube 2 illustrated in FIG. 1 is shown as having a glass funnel 4 sealed to a flangeless faceplate 6.

Three electron guns 54, 56 and 58 in an electron gun assembly are contained in the neck 46 of the tube 2. The three electron guns 54, 56 and 58 are electrically connected to pins 66 through base 68 and are arranged to emit respective streams of electrons 60, 62 and 64. In the FIG. 1 tube the electron guns are disposed in an in-line arrangement, but the guns could be disposed in a triangular arrangement or other suitable interrelationship depending upon the other structural features of the tube construction.

The electron streams 60, 62 and 64 are accelerated in a known manner to pass through a deflection field produced by scanning signals applied to a yoke member (not shown) which is positioned about the neck of 46 of the tube 2 adjacent to the funnel portion 4. This deflection field changes the course of the electron streams in accordance with the instantaneous sweep signals applied to the yoke member. After being deflected the electron streams 60, 62 and 64 are directed through apertures 14 in a color selection electrode or shadow mask 12 to impinge on the scanning side of a multicolor image screen composed of red-light-emissive phosphor elements 8R, green-light-emissive phosphor elements 8G, blue-light-emissive phosphor elements 8B, and a light-absorbing area 10, (which may be omitted) the image screen being disposed on the inside surface of the faceplate 6.

The aperture shadow mask 12 may include a plurality of apertures 14 that are slits in the form of narrow, rectangular openings. Adjacent phosphor elements form triads which correspond in position to each aperture in the mask 12 in such a manner that the electron streams 60, 62 and 64 selectively impinge upon corresponding phosphor elements. See FIG. 2. The mask 12 may also be formed with circular apertures with corresponding circular areas of phosphor elements on the screen portion. Regardless of the particular configuration of the mask and of the image screen, the electron streams are directed through the apertures in the mask to impinge selectively upon respective phosphor elements of the screen.

The different groups of phosphor elements on the screen, regardless of the configuration of the phosphor elements, possess different color emission characteristics, each element emitting light of a different one of the elemental or primary colors when excited by the incidence of an electron stream. Different phosphor materials are used for producing the component colors of green, blue and red.

Figure 2:
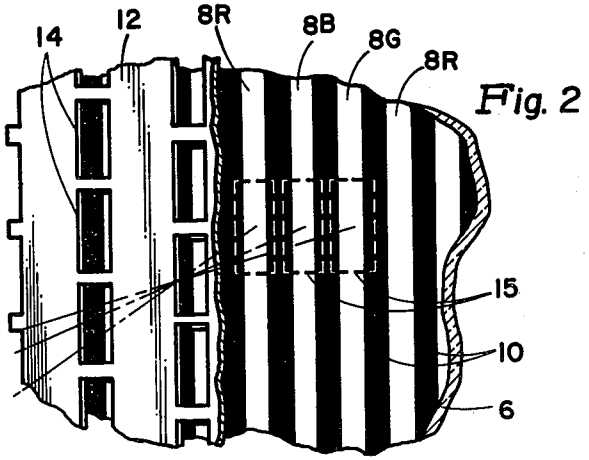
FIG. 2 shows an enlarged portion of the image screen of the FIG. 1 tube showing the phosphor elements and their associated beam landing areas.

The relative positioning of the apertures 14 in the mask 12 with regard to the arrangement of the phosphor elements 8R, 8B and 8G on a multi-color screen is shown at larger scale in FIG. 2 of the drawings. These phosphor elements are arranged in triads and are related to one of the apertures 14 in the mask 12. Preferably an electron-transparent aluminum or other conductive layer (not shown) covers the entire rear surface of the screen to provide increased brightness by reflecting rearward light emission as well as to provide convenient means for maintaining the screen at the operating potential. An aperture 14 in the shadow mask 12 creates a beam landing area 15 when an electron stream passes through the aperture 14. FIG. 2 shows beam landing areas 15 which have a negative tolerance condition with regard to the phosphor elements 8R, 8B, and 8G on which the electron stream impinges. In a negative tolerance condition the beam landing area 15 is larger or wider than the elemental phosphor size at least in the beam scanning direction, by a predetermined misregistration tolerance value; thus part of the beam component impinges upon the light-absorbing material 10 of the screen.

Figure 3:
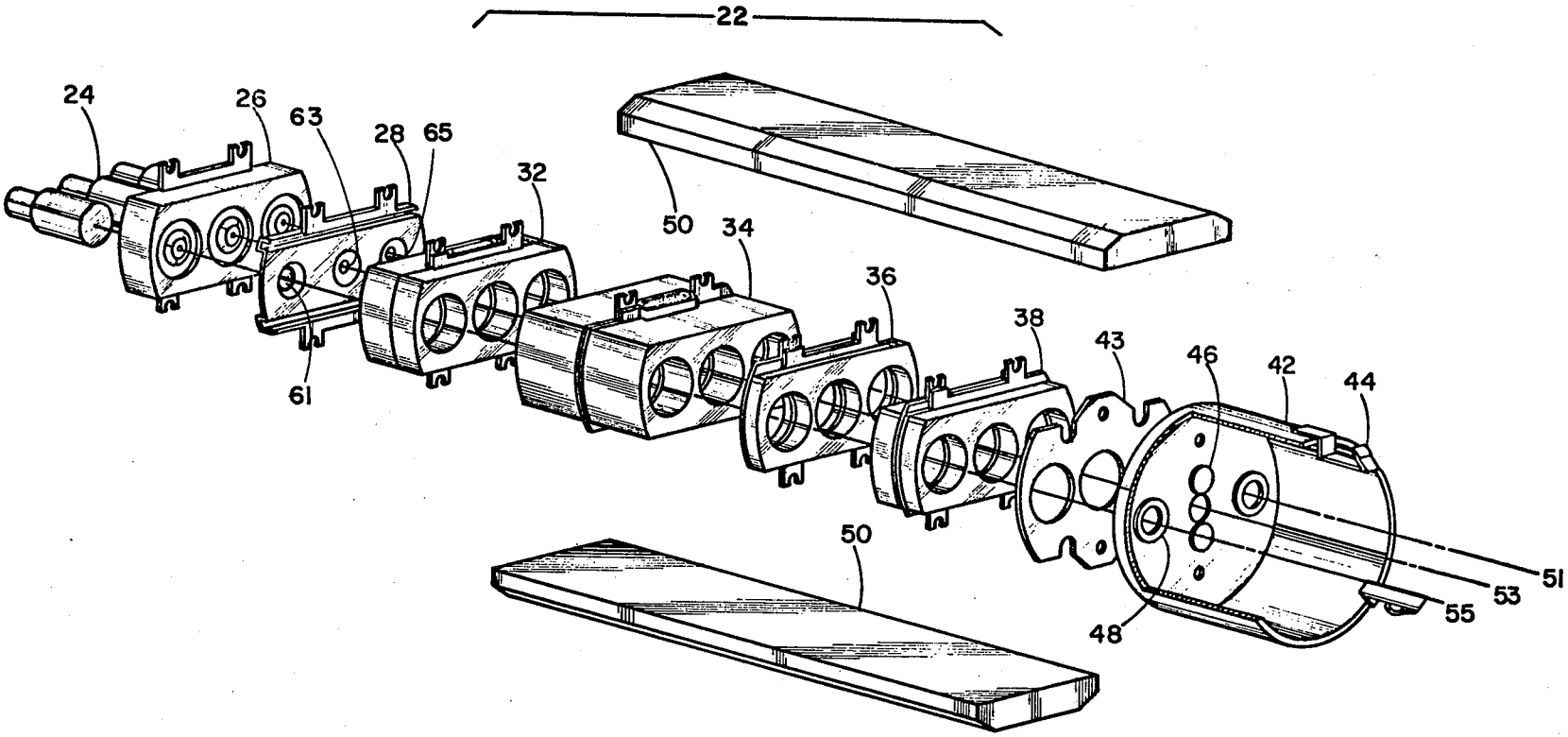
FIG. 3 is an exploded perspective view of the electron gun assembly of the FIG. 1 tube.

FIG. 3 is an exploded perspective view of the electron gun assembly used in the FIG. 1 tube 2. FIG. 3 shows an in-line type gun assembly 22, generating three coplanar electron streams each of which is formed, shaped and directed to selectively energize phosphor elements located on the imaging screen in the expanded area at the opposite end of the color television picture tube envelope (not shown).

The gun assembly 22 has a tetrode section which generates three separate beam cross-overs (not shown), one for each of three electron streams or beams 51, 53 and 55 (red-associated, blue-associated and green-associated). The tetrode section is comprised of four parts: separate cathodes 24 for each beam, a common control electrode 26, a common disc-type accelerating electrode or screen grid 28, and a part of a common electrode 32 ("G3"); that is, the "lower end," or the end nearest the cathode.

Beam cross-overs are imaged on the screen of the color television picture tube by respective main focus lens means. The main focus lens means for the three beams 51, 53 and 55 are unitized and constituted by the upper end section of common main focus electrode 32 and common main focus electrodes 34, 36 and 38. Each of these electrodes 32,34,36 and 38 is electrically isolated from the others and receives predetermined voltages from a power supply to form a single extended main focusing field. The collection of unitized common main focus electrodes 32,34,36 and 38 are termed the "main focus lens" of the gun assembly. The term "main focus lens means" refers to the focus lens structures employed to focus a single beam. The term "main focus electrode means" refers to a discrete individual focus electrode for a single beam, or an allotted portion of a unitized electrode common to other beams.

Further, with reference to FIG. 3, the last in the series of elements that comprise electron beam gun assembly is shield cup 42. Shield cup 42 provides a mounting base for three contact springs 44 which center the forward end of the gun in the neck of the cathode ray tube. Also, by contact with an electrically conductive coating on the inside of the neck of the tube, which is maintained at screen voltage, contact springs 44 convey the screen voltage through shield cup 42 to electrode 38 of the main focus lens. Located within the cavity formed by the shield cup 42, and adjacent to the apertures from which the three electron beams 51, 53 and 55 emerge, are enhancer and shunt magnetic devices. Shield cup 42 is aligned and bonded to electrode 38 in precise registration by means of a carrier plate 43 which lies between the cup and electrode (described and claimed in copending application Ser. No. 649,630 filed Jan. 16, 1976). In the unitized in-line gun described in this disclosure, the common electrodes 26,28,32,34,36 and 38 have on each side thereof at least one pair of widely spaced, relatively narrow claws embedded at widely spaced points in a wide bead 50 (described and claimed in copending application Ser. No. 642,049, filed Dec. 18, 1975, now U.S. Pat. No. 4,032,811).

As noted, except for the three cathodes 24, the individual electrodes are "unitized;" that is, they each comprise one mechanical assembly having individual apertures for the three coplanar beams, 51,53 and 55. The gun electrodes are further characterized by having three effectively continuous, electrically shielding beam passageways extending completely through the electrodes, each passageway being formed by a contiguous axial succession of deep-drawn annular lips.

The current in an electron stream emitted by an electron gun (i) in a color television picture tube is a nonlinear function of the drive voltage (e) on the electron gun ($i \sim e^G$), where G is gamma and expresses the degree of nonlinearity. A nonlinearity of 1/G is introduced at the television transmitter so that the beam current will be proportional to the signal picked up by the camera. Linear phosphors have an output light intensity or brightness (B) which can be expressed by; $B \sim i$: in contrast, the brightness of a nonlinear phosphor can be given by the empirical relation; $B \sim i^M$, where M is a linearity factor (if $M<1$, the phosphor is a sublinear type and, if $M>1$, the phosphor is a superlinear type). Eliminating the electron beam current from the above equations for a linear phosphor yields; $B_L \sim e^{GLM_L} = e^{GL}$ (since $M_L=1$ for a linear phosphor): and for a nonlinear phosphor; $B_{NL} \sim (e^{GNL})^{MNL} = e^{GNL\,MNL}$. In order to have proper tracking, and therefore prevent a grey scale imbalance, the exponents of the drive voltages must be equal to produce equal output light intensity ratios for both the linear and nonlinear phosphor elements. That is: $G_L \cdot M_L = M_{NL} \cdot G_{NL}$. Of course the problem of grey scale imbalance does not occur if all the phosphor elements are formed from a linear phosphor material or from the same type of nonlinear phosphor material. However, in a practical color television picture tube it is typical to use a linear phosphor material for the red phosphor element and sublinear phosphor materials for the green and blue phosphor elements. Thus, a grey scale imbalance shows up as pink highlights. Therefore, when there is any mixture of linear and nonlinear phosphor materials for forming a screen of the color television picture tube or a mixture of different types of nonlinear phosphor materials, (that is, the linearity factors, M, for the phosphors have different values), it is necessary that the exponents of the drive voltages in their relation to the light output intensity of the phosphor elements be equated in some manner to provide for proper tracking as the drive voltages are increased or decreased. Typically, this has been accomplished by the addition of electronic circuitry within the color television receiver which alters in a nonlinear manner the drive voltage of one or more of electron guns in the electron gun assembly. This is an undesirable approach in that it adds electronic components to the receiver, thereby increasing the cost of the receiver. It has generally been believed that with a unitized electron gun assembly it is not possible to alter the electron guns themselves in order to provide different gammas for some or each of the electron guns. By this invention the electron gun assembly can be constructed so that each of the electron guns in the electron gun assembly has the proper gamma to eliminate a grey scale imbalance. This also allows for color television picture tubes having one type of phosphor element to be used in a color television receiver which may formerly have had a tube which used a different type of phosphor element in the screen of the tube.

The present invention will now be described. The present invention provides for a color television picture tube, having a faceplate attached to the mouth of a funnel portion, a novel electron gun assembly. The faceplate has an electron-excitable phosphor screen deposited on the inner surface thereof, the phosphor screen having groups of at least two different types of phosphor elements. The funnel portion has a neck attached thereto opposite the mouth, the neck containing the electron gun assembly which has at least two electron guns for directing at least two streams of electrons towards the phosphor screen. The two types of phosphor elements differ in the intensity of their light output for a predetermined current in the impinging electron stream, that is, they have different functional dependencies on the current of the electron stream. The electron gun assembly is characterized by having when in operation a first means in a first electron gun for causing the first electron gun to have a first value of gamma and a second means in a second electron gun for causing the second electron gun to have a second value of gamma. The first value of gamma is different from the second value of gamma. The first and second values of gamma for the electron gun assembly are such that the light output intensity of the two types of phosphor elements track for equal drive voltages on the electron gun assembly, that is, the light output intensity ratio of the two types of phosphor elements is constant for a given ratio of drive voltages on the first and second electron guns, thereby preventing a grey scale imbalance. The two types of phosphor elements may be either a linear type and a nonlinear type, or two different types of nonlinear type phosphor elements, that is, the nonlinearity of the first type is different from the nonlinearity of the second type. In a linear type phosphor element the light output intensity of the phosphor element is directly proportional to the current in the impinging electron stream and for a nonlinear type phosphor element the light output intensity of the phosphor element is proportional to the current in the impinging electron stream raised to a predetermined power unequal to unity.

For two types of phosphor elements differing in the intensity of their light output for a predetermined current in the impinging electron stream, the current light intensity relationship is determined by $M_1$ for a first type of phosphor element and $M_2$ for a second type of phosphor element. $M_1$ is the exponent of the current (i) in the first impinging electron stream which mathematically relates the current to the light output intensity B1 of the impinged phosphor element of the first type ($B1 \sim i^{M1}$). Similarly, for a second type of phosphor element: $B2 \sim i^{M2}$. The novel electron gun assembly of the present invention is characterized by having a first means in a first electron gun for causing the first electron gun, when in operation, to have a first value of gamma $G_1$ and a second means in a second electron gun for causing a second value of gamma $G_2$ such that the product of $M_1$ and $G_1$ is substantially equal to the product of $M_2$ and $G_2$. This causes the output of the two types of phosphor elements to track for equal drive voltages on the electron gun assembly, that is, the light output intensity ratio of the two types of phosphor elements is constant for a given drive voltage ratio, thereby preventing a grey scale imbalance.

The value of gamma for an electron gun may be altered in a number of different ways. The following changes in the structure of the lower end of the electron gun illustrate some ways of changing the value of gamma: the cathode to control grid spacing, the control grid to screen grid spacing, the thickness of the control grid, or the diameter of the apertures of either the control grid or the screen grid. Of course, what is most desired is a means of changing gamma without changing any other gun parameter, and for the FIG. 3 electron gun assembly this change should be done in a manner which lends itself to a unitized gun construction. Varying the diameter of the apertures for the screen grid in each of the electron guns in the unitized electron gun assembly is desirable since this variation has negligible effect on the focus track characteristics, as compared to varying the diameter of the apertures in the control grid. Therefore, the preferred embodiment of the present invention involves providing different size apertures in the screen grid of the electron gun assembly for each of the electron guns.

In a preferred embodiment of the present invention a first aperture 61 in the screen grid 28 of the electron gun assembly 22 (see FIG. 3) has a diameter of approximately 0.031 inches and the second and third apertures 63, 65 in the screen grid 28 have a diameter of approximately 0.025 inches. (At this point, although the electron gun assembly is unitized, a first, second and third electron gun will be referred to in the sense that the coaxial apertures through the electron gun assembly define three electron guns.) The first aperture 61 causes the first electron gun of the electron gun assembly 22 to have a first value of gamma of approximately 2.30 and the second and third apertures 63, 65 cause the second and third electron guns respectively to have a second value of gamma of approximately 2.55. When this electron gun assembly is used with a phosphor screen having a red linear-type phosphor element and blue and green sublinear-type phosphor elements (the red linear type phosphor element corresponding to the electron gun having the larger aperture 61), the light output intensity of the two different types of phosphor elements track for equal drive voltages on the electron gun assembly, thereby preventing a grey scale imbalance. In the current-light intensity relationship ($B_1 \sim i^{M1}$), for the linear type phosphor element, $M_1$ has a value in the range 0.97 to 1.00. For the nonlinear type phosphor element $M_2$ has a value of approximately 0.90. The size of aperture 61 in the screen grid 28 is the first means in the first electron gun for causing the first electron gun to have a first value, $G_1$, of gamma of approximately 2.30, and the diameter of apertures 63 and 65 is the second means in the second and third electron guns for causing the second and third electron guns each to have a second value, $G_2$, of gamma of approximately 2.55. The product of $M_1$ and $G_1$ is substantially equal to the product of $M_2$ and $G_2$, thereby causing the luminous output of the two types of phosphor elements to track for equal drive voltages on the electron gun assembly.

Whatever means is used to vary the structure of the electron guns within the electron gun assembly in order to produce different values of gamma for the electron guns, a first electron gun will have a first predetermined internal electron stream field configuration and a second electron gun will have a second predetermined internal electron stream field configuration. The first and second field configurations are different from each other and are such that the light output intensity of the two different types of phosphor elements track for equal drive voltages on the electron gun assembly.

The preferred embodiment of the present invention was designed in the following manner. Computer studies were run on the variation of beam current with the drive voltage for an electron gun of specified design and several variants thereof. These variants were the design center gun with one of the lower end parameters changed; in each, either the cathode to control grid spacing, the control grid to screen grid spacing, the thickness of the control grid, or the diameter of the aperture of either the control grid or the screen grid was changed. These changes consisted of either an increase or a decrease of 0.001 inch from the design center value. For each of these ten variants and the design center gun the value of gamma was determined. Because gamma, the beam current, and the drive voltage are related by the nonlinear equation; $i=e^G$, this relationship was linearized into: $\text{Log } i = G \cdot \text{Log } e$, and the value of gamma was determined by a linear least squares fit. The values of gamma were then fit to the mechanical dimensions with a quadratic correlation: $G=a_2x^2+a_1x+a_0$, where x is a mechanical dimension and the a's are determined by a quadratic least squares fit. Since a change in the diameter of the apertures in the screen grid had negligible effect on the focus track characteristics this parameter was selected to control the value of gamma in the electron guns of electron gun assemblies.

Figure 4:
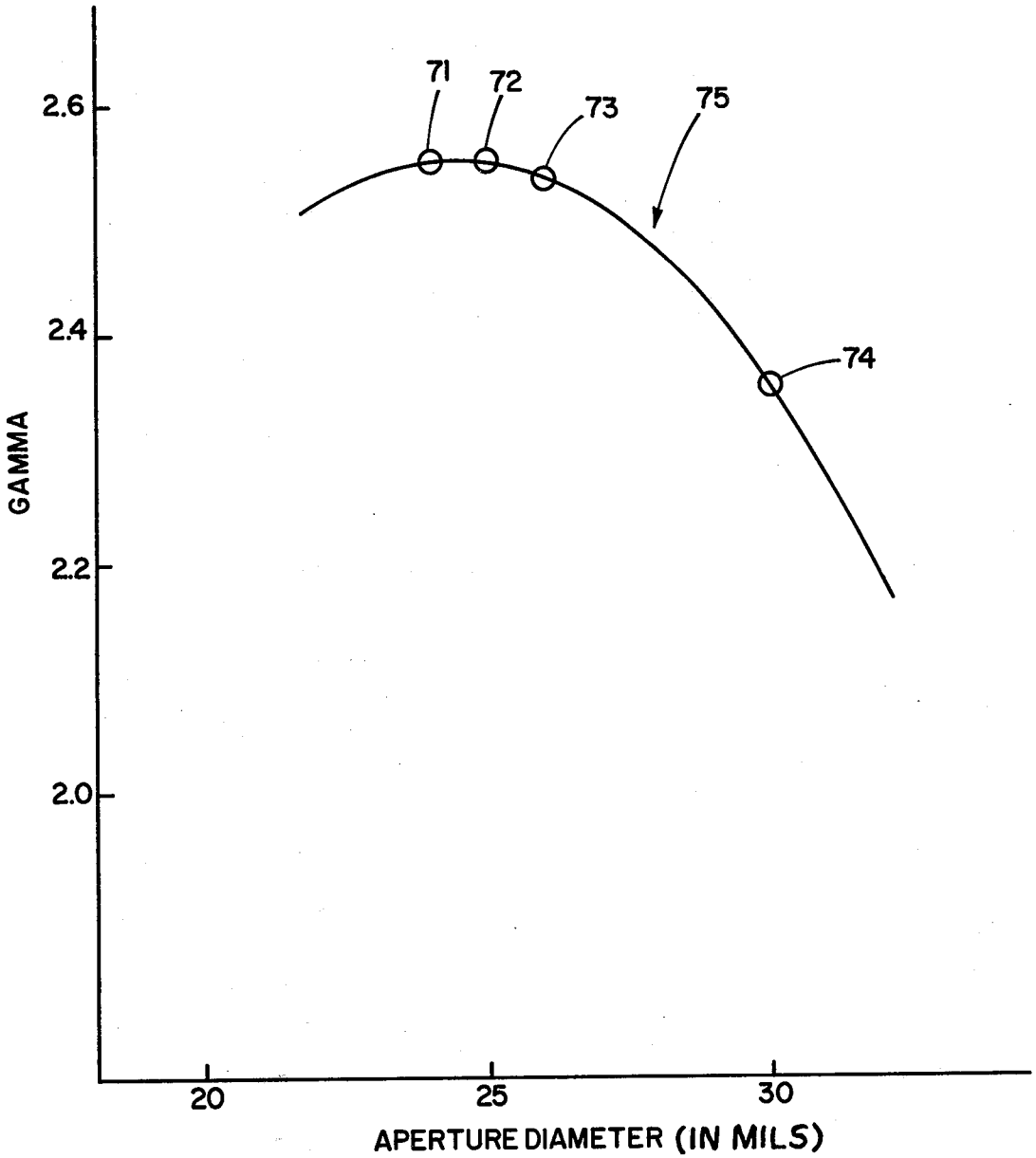
FIG. 4 is a graph showing the relationship of the value of gamma as a function of the size of an aperture in the screen grid for the electron guns in the FIG. 3 electron gun assembly.

FIG. 4 is a graph showing the change in gamma versus the size of the aperture in the screen grid. Points 71–74 represent actual values of four electron guns based on computer runs of beam current versus drive voltage. The solid line 75 is a quadratic least squares fit.

In the relationship; $M_L \cdot G_L = M_{NL} \cdot G_{NL}$, $M_L$ (for the red linear phosphor element) is approximately unity and $M_{NL}$ (applicable to both the blue and green sublinear phosphor elements) is approximately 0.9. Therefore it is required that; $G_L = 0.9\ G_{NL}$. Referring to the FIG. 4 graph, the only variation in gamma that can be produced from the design center (point 72) is a decrease. Therefore, by setting $G_{NL}=2.55$, which is obtained by using an aperture with a diameter of 0.0250 inches, and $G_L=2.30$, which is obtained by using an aperture with a diameter of 0.0307 inches, $G_L=0.9\ G_{NL}$.

The invention is not limited to the particular details of the apparatus depicted and other modifications and applications are contemplated. For example, this invention may be utilized with other electron gun assembly configurations, such as delta-type guns and bipotential-type guns. Also, this invention is equally applicable to dot-type screens as well as other screen configurations including screens having positive and/or negative guard bands. Certain other changes may be made in the above described method without departing from the true spirit and scope of the invention herein involved. It is intended therefore that the subject matter in the above depiction shall be interpreted as illustrative and not in a limiting sense.

What is claimed is:

1. For use in a color television picture tube having a faceplate attached to the mouth of a funnel portion; said faceplate having an electron excitable phosphor screen deposited on the inner surface thereof, said phosphor screen having groups of at least two different types of phosphor elements, said funnel portion having a neck attached thereto opposite said mouth, said neck containing an electron gun assembly having at least two electron guns for directing at least two streams of electrons towards said phosphor screen, said two types of phosphor elements differing in the intensity of their light output for a predetermined current in the impinging electron stream, that is, they have different functional dependencies on the current of the electron streams, said electron gun assembly being characterized by having first means in a first electron gun for causing said first electron gun to have a first value of gamma and second means in a second electron gun for causing said second electron gun to have a second value of gamma, said first value of gamma being different from said second value of gamma, said first and second values of gamma for said electron gun assembly being such that the light output intensity ratio of said two types of phosphor elements is substantially constant for a given ratio of drive voltages on said first and second electron guns.

2. The apparatus defined in claim 1 wherein said first type of phosphor element is a linear type, that is, the light output intensity of the phosphor element is directly proportional to the current in the impinging electron stream, and said second type of phosphor element is a nonlinear type, that is, the light output intensity of the phosphor element is proportional to the current in the impinging electron stream raised to a predetermined power unequal to unity.

3. The apparatus defined in claim 2 wherein said second type of phosphor element is a sublinear type.

4. The apparatus defined in claim 2 wherein said second type of phosphor element is a superlinear type.

5. The apparatus defined in claim 1 wherein said first and second types of phosphor elements are both nonlinear types, that is, the light output intensity of the phosphor element is proportional to the current in the impinging stream raised to a predetermined power unequal to unity, the nonlinearity of said first type being different from the nonlinearity of said second type.

6. For use in a color television picture tube having a faceplate attached to the mouth of a funnel portion, said faceplate having an electron-excitable phosphor screen deposited on the inner surface thereof, said phosphor screen having groups of at least two different types of phosphor elements, said funnel portion having a neck attached thereto opposite said mouth, said neck containing an electron gun assembly having at least two electron guns for directing at least two streams of electrons towards said phosphor screen, said two types of phosphor elements differing in the intensity of their light output for a predetermined current in the impinging electron stream, that is, they have different functional dependencies on the current of the electron stream, the current-versus-light-intensity relationship being determined by $M_1$ for a first type of phosphor element and $M_2$ for a second type of phosphor element, $M_1$ being an exponent of the current in a first impinging electron stream which mathematically relates the current to the light output intensity of the impinged phosphor element of said first type and $M_2$ being an exponent of the current in a second impinging electron stream which mathematically relates the current to the light output intensity of the impinged phosphor element of said second type, said electron gun assembly being characterized by having, when in operation, first means in a first electron gun for causing said first electron gun to have a first value, $G_1$ of gamma and a second maans in second electron gun for causing said second electron gun to have a second value, $G_2$, of gamma, such that the product of $M_1$ and $G_1$ is substantially equal to the product of $M_2$ and $G_2$, thereby causing the luminous intensity ratio output of said two types of phosphor elements to be dependent substantially only on the ratio of drive voltages on said first and second electron guns.

7. For use in a color television picture tube having a faceplate attached to the mouth of a funnel portion; said faceplate having an electron excitable phosphor screen deposited on the inner surface thereof, said phosphor screen having triads of red, green and blue phosphor elements, said red phosphor element being a linear type phosphor element and said green and blue phosphor elements being nonlinear type phosphor elements, said funnel portion having a neck attached thereto opposite said mouth, said neck containing an electron gun assembly having three electron guns for directing three streams of electrons towards said phosphor screen, said linear and nonlinear types of phosphor elements differing in the intensity of their light output for a predetermined current in the impinging electron stream, that is, they have different functional dependencies on the current of the electron stream, the current-versus-light-intensity relationship being determined by $M_1$, having a value in the range 0.97 to 1.00, for said linear type of phosphor element and $M_2$, having a value of approximately 0.90, for said nonlinear type of phosphor element, $M_1$ being an exponent of the current in a first impinging electron stream which mathematically relates the current to the light output intensity of the impinged phosphor element of said linear type and $M_2$ being an exponent of the current in a second impinging electron stream which mathematically relates the current to the light output intensity of the impinged phosphor element of said nonlinear type, said electron gun assembly being characterized by having, when in operation, a first means in a first electron gun for causing said first electron gun to have a first value of gamma $G_1$ of approximately 2.30 and a second means in second and third electron guns for causing said second and third electron guns each to have a second value of gamma $G_2$ of approximately 2.55, such that the product of $M_1$ and $G_1$ is substantially equal to the product of $M_2$ and $G_2$, thereby causing the luminous intensity ratio of said two types of phosphor elements to be dependent substantially only on the ratio of drive voltages on said electron guns, thereby preventing a grey scale imbalance.

8. The apparatus defined by claims 3 or 6 wherein said first and second electron guns each have first and second screen grid means, respectively, and wherein said first and second screen grid means have beam-passing apertures of different sizes to cause said first and second electron guns to have said different first and second values of gamma.

* * * * *